US009721748B2

(12) United States Patent
Seryi

(10) Patent No.: US 9,721,748 B2
(45) Date of Patent: Aug. 1, 2017

(54) X-RAY GENERATION

(71) Applicant: Isis Innovation Limited, Oxford, Oxfordshire (GB)

(72) Inventor: Andrei Seryi, Oxford (GB)

(73) Assignee: OXFORD UNIVERSITY INNOVATION LIMITED, Oxford (GB)

( * ) Notice: Subject to any disclaimer, the term of this patent is extended or adjusted under 35 U.S.C. 154(b) by 433 days.

(21) Appl. No.: 14/354,299

(22) PCT Filed: Oct. 24, 2012

(86) PCT No.: PCT/GB2012/052632
§ 371 (c)(1),
(2) Date: Apr. 25, 2014

(87) PCT Pub. No.: WO2013/061051
PCT Pub. Date: May 2, 2013

(65) Prior Publication Data

US 2014/0299782 A1 Oct. 9, 2014

(30) Foreign Application Priority Data

Oct. 27, 2011 (GB) ..... 1118556.8

(51) Int. Cl.
*H01J 35/00* (2006.01)
*H01J 35/02* (2006.01)
(Continued)

(52) U.S. Cl.
CPC ..... *H01J 35/02* (2013.01); *H05G 2/00* (2013.01); *H05H 9/00* (2013.01); *H05H 7/18* (2013.01)

(58) Field of Classification Search
CPC .... H05G 2/008; H05H 9/00; H05H 2007/007; H05H 7/18
(Continued)

(56) References Cited

U.S. PATENT DOCUMENTS 4,323,857 A 4/1982 Brau et al.
4,479,218 A 10/1984 Brau et al.
(Continued)

FOREIGN PATENT DOCUMENTS

JP 11067498 3/1999
JP 2000200699 7/2000

OTHER PUBLICATIONS

R. W. Warren et al., "Recent results from the Los Alamos free electron laser", Nuclear Instruments and Methods in Physics Research A259 (1987) 8-12.
(Continued)

*Primary Examiner* — David J Makiya
*Assistant Examiner* — Kenneth J Malkowski
(74) *Attorney, Agent, or Firm* — O'Shea Getz P.C.

(57) ABSTRACT

An apparatus for generating x-rays includes an electron beam generator and a first device arranged to apply an RF electric field to accelerate the electron beam from the generator. A photon source is arranged to provide photons to a zone to interact with the electron beam from the first device so as to generate x-rays via inverse-Compton scattering. A second device is arranged to apply an RF electric field to decelerate the electron beam after it has interacted. The first and second devices are connected by RF energy transmission means arranged to recover RF energy from the decelerated electron beam as it passes through the second device and transfer the recovered RF energy into the first device.

21 Claims, 9 Drawing Sheets

(51) Int. Cl.

| | |
|---|---|
| ***H05G 2/00*** | (2006.01) |
| ***H05H 9/00*** | (2006.01) |
| *H05H 7/18* | (2006.01) |

(58) Field of Classification Search
USPC ..... 378/121, 122
See application file for complete search history.

(56) References Cited

U.S. PATENT DOCUMENTS

| | | | | |
|---|---|---|---|---|
| 6,332,017 | B1 | 12/2001 | Carroll et al. | |
| 7,391,850 | B2 | 6/2008 | Kaertner et al. | |
| 7,499,476 | B1 | 3/2009 | Hutton | |
| 2004/0228445 | A1 | 11/2004 | Kucharczyk | |
| 2005/0213708 | A1 | 9/2005 | Lawrence et al. | |
| 2006/0251217 | A1 | 11/2006 | Kaertner et al. | |
| 2008/0164418 | A1 | 7/2008 | Shahar et al. | |
| 2009/0065701 | A1 | 3/2009 | Bale et al. | |
| 2009/0074145 | A1 | 3/2009 | Vadari et al. | |
| 2010/0027753 | A1 | 2/2010 | Venugpal et al. | |
| 2010/0080356 | A1 | 4/2010 | Ishida et al. | |
| 2010/0284517 | A1 | 11/2010 | Ahlawat et al. | |
| 2010/0284518 | A1 | 11/2010 | Ahlawat et al. | |
| 2013/0083880 | A1* | 4/2013 | Noonan | G21G 1/10 376/190 |

OTHER PUBLICATIONS

Ryoichi Hajima "Energy Recovery Linacs for Light Sources", Reviews of Accelerator Science and Technology vol. 3 (2010) 1-26.

G. Spalek et al., "The free-electron laser variable bridge coupler", IEEE Transactions on Nuclear Science, vol. NS-32, No. 5, Oct. 1985.

Kazuhisa Nakajima, "Towards a table-top free-electron laser", Nature Physics vol. 4, (2008), pp. 92-93.

D. W. Feldman et al., "The Los Alamos Free-Electron Laser Energy-Recovery Experiment", Proceedings of the 1987 Particle Accelerator Conference, p. 221.

Isidoro E. Campisi, "State of the Art Power Couplers for Superconducting RF Cavities", Jun. 4, 2002.

David E. Moncton "Inverse Compton Scattering: A Small Revolution in X-ray Sources and Applications", May 16, 2006.

Wolf-Dietrich Mier, "High Power Coupler for the European XFEL", 5th Mac Meeting May 31, 2005.

Alice—"Accelerators and lasers in combined experiments", Compton Backscattering Experiment, May 16, 2011, http://alice.stfc.ac.uk/projects/CBS/index.html.

Lyncean Technologies Inc., Science and Technology, Apr. 12, 2011, http://www.lynceantech.com/sci_tech.html.

* cited by examiner

X-RAY GENERATION

This application is entitled to the benefit of, and incorporates by reference essential subject matter disclosed in PCT Application No. PCT/GB2012/052632 filed on Oct. 24, 2012, which claims priority to Great Britain Application No. 1118556.8 filed Oct. 27, 2011.

BACKGROUND OF THE INVENTION

1. Technical Field

The present invention relates to apparatus and methods for accelerating electrons and extracting energy from electron beams or other particle beams, in particular to techniques for generating x-rays.

2. Background Information

X-rays can be generated by accelerating electrons to high speeds. Conventional methods of x-ray generation use a linear particle accelerator to accelerate electrons to energies of several keV or even MeV. A conventional cathode ray tube emits an electron beam that is accelerated towards a target anode where electromagnetic radiation is generated upon impact. Soft x-rays having energies of 0.12 to 12 keV and wavelengths of 10 to 0.1 nm can be generated in this way. In more recent times linear accelerators such as the Stanford Linear Accelerator Center (SLAC) typically achieve electron energies around 3 GeV by using RF fields to progressively accelerate an electron beam as it passes through a vacuum tube containing segmented electrodes. Such high energy electron beams can be circulated in a storage ring using synchronized electric and magnetic fields to provide a source of synchrotron radiation including x-rays. These extremely bright (i.e. high flux) x-rays can be used to investigate molecular structures, resulting in many bio-medical applications such as protein crystallography.

While synchrotron light sources such as the one at SLAC and the Diamond light source in the UK can provide researchers with very hard and bright x-rays for experimental studies, such facilities are extremely large, costly to run and not readily available to everyone. The Diamond light source is housed in a toroidal building that is 738 m in circumference and covers an area in excess of 43,300 m2. Although the x-rays from a synchrotron source can be a billion times brighter than those, for example, generated by cathode ray tubes for normal medical imaging, a synchrotron source converts only a tiny fraction of the energy of the electrons into radiation. Furthermore the natural synchrotron light is not monochromatic and its application, for example, to phase-contrast imaging may require the use of sophisticated insertion devices and other techniques. Alternative x-ray sources are required that can meet academic and industry demands on a more accessible scale.

One alternative to synchrotron light sources is a linear accelerator(linac)-based coherent light source such as the Linac Coherent Light Source (LCLS) at SLAC. This facility couples a linear particle accelerator with a free electron laser (FEL) to produce intense x-rays. In a free electron laser the electron beam itself is used as the lasing medium. The electron beam from the linac is injected into an undulator or "wiggler"—an array of magnets arranged with alternating poles along the light beam interaction path to slightly wiggle the electron beam transversely and stimulate the emission of coherent electromagnetic radiation in the form of x-rays. FEL radiation is monochromatic and extremely bright—the process of self-amplified spontaneous emission extracting a much greater fraction of the electrons' energy than can synchrotron radiation. In fact FEL x-ray sources can be many orders of magnitude brighter than synchrotron light sources.

Some researchers have demonstrated energy recovery in conjunction with a free electron laser by decelerating the electron beam after it passed through a wiggler. The ALICE accelerator at Daresbury Laboratory in the UK has coupled an energy recovery linac to the undulator of a free electron laser generating light in the mid-IR range. In such a proposal the spent electron beam is returned back to the entrance of the main linac via an additional beam path at a precise time when the RF phase is exactly opposite to the initial accelerating phase such that the beam is decelerated and energy can be recovered back to the electromagnetic field inside the linac RF cavities. This energy recovery technique requires an accurate adjustment of the electron beam path length that is accomplished by moving the arc of the beam path as a whole.

While accelerators such as the LCLS at SLAC and ALICE at Daresbury Laboratory have demonstrated the potential of FELs as light sources, there are several drawbacks. Such facilities are extremely large—the LCLS based on a linear accelerator at SLAC, for example, is over 3 km long in total and includes a 600 m linac, 230 m electron beam transport tunnel, 170 m undulator and over 300 m of tunnels to transport x-rays to experimental halls. The overall billion dollar-scale cost and huge size of such machines means that they can only be constructed at a national level. There remains a need for smaller research bodies to have access to their own x-ray source facilities.

Researchers at MIT have recently proposed an alternative x-ray source that is potentially smaller than the LCLS or other sources based on the principle of a free electron laser. This alternative technique uses inverse-Compton scattering to generate x-rays when an electron beam is collided with photons e.g. from a laser beam. U.S. Pat. No. 7,391,850 describes such a laboratory scale x-ray source. In order to generate x-rays having energies on the keV scale, the electron beam is accelerated to energies of the order of tens of MeV using a linear accelerator comprising superconducting RF cavities. The accelerator module is contained in a cryostat operating at a temperature of 2 K. Although smaller than the other light sources discussed above, the accelerator cryomodule is still over 3 m long and requires a significant power supply for the RF cavities in the superconducting accelerator. Much of the input power is wasted as the electron beam is dumped following its interaction with the laser beam.

Another x-ray source that is based on inverse-Compton scattering is the Compact Light Source from Lyncean Technologies. Instead of using a linear accelerator with superconducting RF cavities, an electron beam is circulated in a laboratory-sized storage ring and interacted with a laser beam to generate x-rays. While this source is able to generate x-rays on a much smaller scale than conventional synchrotron light sources, the power requirements are still quite large as a beam injector must be able to accelerate bunches of electrons up to 25 MeV. The electron bunches are then circulated in the storage ring for about one million turns as the interaction rate is very low. While the circulating electron beam can interact with the laser beam a large number of times, it is difficult to create a large electron current in a small ring so the energy efficiency of the process is limited. Electrons that do not interact are dumped after completing their circulation. This method of x-ray generation may therefore be considered to have a low energy efficiency.

While x-ray sources based on inverse-Compton scattering have shown potential in terms of reduced size and cost, there remains a need for a compact x-ray source that can efficiently generate high-energy and high-flux x-rays for use in a wide range of experiments.

SUMMARY OF THE INVENTION

According to a first aspect of the present invention there is provided an apparatus for generating x-rays comprising: an electron beam generator; a first device arranged to apply an RF electric field to accelerate the electron beam from the generator; a photon source arranged to provide photons to interact with the electron beam from the first device so as to generate x-rays via inverse-Compton scattering; and a second device arranged to apply an RF electric field to decelerate the electron beam after it has interacted; wherein the first and second devices are connected by RF energy transmission means arranged to recover RF energy from the decelerated electron beam as it passes through the second device and transfer the recovered RF energy into the first device.

The RF energy recuperated from the decelerated electron beam in the second device may be used to drive acceleration of the electron beam in the first device and thus reduce the RF power demand or increase the overall beam power. The invention recognizes that energy can be recuperated because only a fraction of the electrons in the beam will interact with photons to generate x-rays via inverse-Compton scattering and this unused energy is wasted if the electron beam is dumped after interaction. For the same RF power input, the maximum power of the electron beam can be at least 20 times higher than would be possible without energy recuperation. By reducing the input power required for a given beam energy, the accelerator device can be made smaller by reducing the length of the accelerating beam path and the RF (radio frequency) power source can also be reduced in size, making the apparatus better suited for laboratory use.

Furthermore, in addition to the apparatus being able to efficiently produce a high energy electron beam and generate "hard" x-rays of keV scale energies, the apparatus can be made more compact than known x-ray sources. It will be appreciated that the second device for decelerating the beam and the RF energy transmission means being independent of the first accelerator device means that it is no longer necessary to adjust the beam path length to swap the RF phase between accelerating and decelerating modes. Instead, continuous or near-continuous operation of the x-ray source is possible with an electron beam being simultaneously accelerated prior to interaction and decelerated after interaction to recuperate energy which is transferred back into the accelerator device without requiring interruption to adjust the beam path. Furthermore, the beam path length between the accelerator device and the decelerator device can be minimized as only the inverse-Compton scattering interaction point needs to be considered when a dedicated RF energy transmission means is arranged between the first and second devices.

While the electron beam may be accelerated/decelerated by any suitable RF device, in order to help make the apparatus as compact as possible it is preferred that the first and second devices are arranged to accelerate/decelerate the electron beam by applying the RF electric field along a linear axis. In other words, the first and second devices are preferably linear accelerators. When the electron beam is accelerated/decelerated along a straight path there is no need for a magnetic field to be applied to bend the beam path and thus the energy recuperation can be solely taken from the electric field. While such embodiments can represent a more straightforward and efficient method of energy recuperation, it may also be possible to recuperate energy from an electron beam in the presence of both applied electric and magnetic fields e.g. where it is desired to bend the beam path. However the following description focuses on linear accelerators according to various preferred sets of embodiments as this geometry can make it easier to achieve an overall compact design for the apparatus.

The RF electric field may be applied by a plurality of segmented electrodes, with the electron beam preferably passing through apertures in the electrodes. However, for efficiency purposes, it is preferred that the first and second (preferably linear), devices which are arranged to apply an RF electric field each comprise one or more RF cavities i.e. waveguide cavities tuned to create RF standing waves. Each of the first and second (preferably linear), devices may comprise a plurality of RF cavities arranged in series. The RF cavities can achieve high beam energies by propagating resonant electromagnetic waves. While it is the RF electric field applied by each device that performs acceleration/deceleration, it will be appreciated of course that the electromagnetic waves themselves comprise both electric and magnetic field components.

The RF cavities may be formed from a normal-conducting metallic material, for example copper, and operated near room temperature (e.g. with water cooling to remove the heat generated by electrical loss in the cavities). However, in order to help reduce energy losses due to RF heating, the RF cavities are preferably formed from or coated with superconducting material(s) e.g. such as niobium.

One of the benefits of using superconducting RF cavities in the first/second accelerator/decelerator device is that they can provide large apertures, resulting in low beam impedance and higher thresholds against deleterious beam instabilities. Normal-conducting cavities, on the other hand, need small beam apertures to concentrate the electric field and compensate for power losses from wall currents. Superconducting RF cavities allow the excitation of electromagnetic fields at high duty cycle and can even allow continuous wave (CW) operation, whereas in normal-conducting cavities electrical losses in a CW regime could melt the copper walls (even with robust water cooling). Another advantage of using superconducting RF cavities is that nearly all of the input RF power goes into the beam. The RF source driving the cavities of the first device need only provide the RF power that is required to be absorbed by the beam being accelerated, since the RF power dissipated in the superconducting walls is negligible. This is in contrast to normal-conducting cavities where the wall power loss can easily equal or exceed the beam power consumption. The input RF power requirement is important since all typical RF source technologies, whether Klystron, Inductive Output Tube (IOT), or solid state amplifier, have costs that increase dramatically with increasing RF power.

Preferably the first device is arranged to accelerate electrons up to energies in the range of 10 MeV to 30 MeV. However, as compared to existing accelerators, the input power required to reach such electron energies is relatively low due to the beneficial effect of energy recuperation. After deceleration in the second device the electron beam energy (e.g. at dump) is preferably only about 0.2 MeV, 0.1 MeV, or less. The first device may therefore require an RF input power, for example, of only 2 kW for a 10 MeV electron beam, based on an electron current of 0.01 A. A higher electron current is also possible (see Table 1 below) and the power will vary in proportion to the electron current.

An important feature of the present invention is the RF energy transmission means arranged to transfer into the first device RF energy recovered from the decelerated electron beam as it passes through the second device. Any suitable electromagnetic coupling may be used for the RF transmission means, including coaxial (e.g. capacitive) couplings and waveguide couplings. A waveguide coupling may be provided by an electrically conducting waveguide. A proper waveguide in the form of an electrically conducting cavity is preferred, both for simplicity and to reduce impedance mismatch with the RF devices themselves which, as described above, preferably comprise a plurality of conducting RF cavities. Thus in a preferred set of embodiments the RF energy transmission means comprises one or more RF waveguides connecting the first and second devices. The RF waveguides can efficiently transfer recovered RF energy in the form of electromagnetic radiation from the second device to the first device. Again, in order to help reduce energy losses due to RF heating, the RF waveguide(s) are preferably formed from or coated with superconducting material(s) as discussed above. Preferably the RF waveguide(s) are formed of the same superconducting material as the RF cavities of the first and second devices. In such embodiments the RF waveguide(s) can be considered as a continuation of the first and second devices so that impedance matching is not an issue. RF power losses can therefore be minimized for efficient power recuperation.

While the invention has so far been described in the context of interacting an accelerated electron beam with photons to generate x-rays via inverse-Compton scattering, the applicant has recognized that in fact the benefits of energy recuperation, in particular the highly efficient energy flow between the accelerator devices achieved by superconducting RF cavities, may find wider application in any process that involves the extraction of energy from an electron beam. For example, an electron beam may be accelerated before being passed through an undulator to generate electromagnetic radiation having a range of wavelengths, including x-rays, or the high energy accelerated electron beam may be used directly e.g. for electron diffraction studies.

This feature is considered novel and inventive in its own right and thus according to a second aspect of the present invention there is provided an apparatus for extracting energy from an electron beam comprising: an electron beam generator; a first device comprising a plurality of superconducting RF cavities in which an RF electric field is applied to accelerate the electron beam; means arranged to extract energy from the accelerated electron beam through an interaction process; and a second device comprising a plurality of superconducting RF cavities in which an RF electric field is applied to decelerate the electron beam after it has interacted; wherein the first and second devices are connected by one or more superconducting RF waveguide(s) arranged to recover RF energy from the decelerated electron beam as it passes through the second device and transfer the recovered RF energy into the first device.

According to embodiments of this second aspect of the invention the interaction process may comprise one or more of: interacting the electron beam with photons to generate x-rays via inverse-Compton scattering (as described above); passing the electron beam through an undulator or applying an alternating magnetic field to generate electromagnetic radiation; directing the electron beam onto a target to cause emission and/or fluorescence; interacting the electron beam directly with a sample for electron diffractometry or microscopy; and other uses of a high energy electron beam. The electron beam power achievable can be much higher than in other apparatus, especially those on a smaller laboratory scale, due to the benefits of energy recuperation with minimal RF power loss in the superconducting cavities and waveguide(s). Any of the preferred features and embodiments described above with respect to the first aspect of the invention may equally be applied to this second aspect of the invention.

In embodiments of both the first and second aspects of the invention it may be preferred for the first and second devices comprising superconducting RF cavities and the superconducting RF waveguide(s) to be integrally formed or connected together (for example, by electron beam welding). Such an integrated structure can maximize the RF energy transfer efficiency whatever the nature of the interaction process used to extract energy from the electron beam. A further advantage is that the superconducting RF components can be cooled together in the same cryostat, for example a vacuum chamber containing an insulated bath of liquid helium. A significant operating cost for superconducting RF devices is the cryogenics required and thus collecting together these components in as compact an arrangement as possible with a shared cryostat can reduce the burden of the cryomodule.

In order to save space and improve cooling efficiency, the first/second accelerating/decelerating devices and the RF energy transmission means e.g. superconducting RF waveguide(s) connected between them are preferably contained in the same cryomodule. Such integration is facilitated when the first and second (preferably linear) devices are arranged substantially in parallel with a minimal coupling distance between them. By providing for acceleration, deceleration and energy recuperation all in the same cryostat a more compact electron beam apparatus can be achieved. This feature is applicable to both aspects of the invention outlined above.

In seeking to make a more energy efficient and compact electron beam apparatus, the applicant has recognized that a substantial factor in the size of a typical particle accelerator is not only the dimensions of the individual accelerator(s) but also the need for accompanying cryomodule(s) when superconducting electrodes and/or magnets are used to accelerate the particle beam. Accordingly this feature is considered to be novel and inventive in its own right, regardless of the nature of the particle beam, and thus when viewed from a third aspect the present invention provides an apparatus for extracting energy from a particle beam comprising: a particle beam generator; a first superconducting device arranged to apply an electric and/or magnetic field to accelerate the particle beam; means arranged to extract energy from the accelerated particle beam through an interaction process; a second superconducting device arranged to apply an electric and/or magnetic field to decelerate the particle beam after it has interacted; and superconducting means arranged to recuperate energy from the particle beam as it passes through the second device and transfer the recuperated energy into the first device; wherein at least the first device, second device and superconducting means are provided together in a cryostat.

This aspect of the invention takes advantage of the energy recuperation technique described above in conjunction with a more efficient cryo-cooling arrangement to make a particle beam apparatus both more energy efficient and potentially more compact. A single cryostat may be provided to cool the main components that accelerate, decelerate and recuperate energy from the particle beam. The particle beam may comprise one or more of: electrons, positrons, protons, or ions. Any of the preferred features and embodiments described above with respect to the first and second aspects of the invention may equally be applied to this third aspect of the invention. Moreover, regardless of whether the particle beam comprises an electron beam, the feature of integrating the accelerating device, decelerating device and energy recuperation means in a single cryostat may be found particularly beneficial when these components comprise RF cavities formed of a superconducting material and energy is recuperated in the form of RF radiation. The first and second devices may be in the form of a linear accelerator. However this third aspect of the invention may also be applied to apparatus comprising non-linear devices for accelerating/decelerating the particle beam, including circular accelerators, cyclotrons and synchrotrons.

Additional components of the particle beam apparatus may advantageously be integrated with the cryostat. In one set of embodiments, the means extracting energy from the particle beam can be provided in the cryostat. On the other hand, the design of the apparatus may be simplified by placing the interaction point, e.g. with a photon beam, outside the cryostat. Where an array of superconducting magnets is used to transport, focus and/or compress the accelerated beam for interaction then this may beneficially be embedded in the same cryostat as the accelerating/decelerating devices.

Additionally or alternatively, in another set of embodiments the particle beam generator can be provided in the cryostat. For example, an electron gun in the form of a RF photoinjector may be formed of a superconducting material and take advantage of the cryostat. Furthermore, it is preferable that the electron (or other particle) beam generator is integrally formed with one or more superconducting RF cavities of the first device. Providing an RF superconductive injector gun as an integral part of the first accelerator device can significantly improve the compactness of the apparatus while helping to maximize the RF power that goes into the beam. However any particle beam dump is preferably located outside the cryostat so as to minimize the cryo-cooling power.

There will now be described some features that can be applied to embodiments of any of the aspects of the invention outlined above.

In one set of embodiments a single RF waveguide may be arranged to provide a common path for transferring RF energy from the second decelerator device to the first accelerator device. In another set of embodiments multiple waveguides may be arranged to connect the first and second devices, for example each RF cavity in the decelerator device preferably being coupled to a corresponding RF cavity in the accelerator device by a separate RF waveguide. Such arrangements may optimize the transfer of recuperated energy, for instance with each quantum recuperated in one RF cavity in the decelerator device being transferred to a respective RF cavity in the accelerator device to provide individual energy boosts for each RF cavity.

The first/second accelerator/decelerator devices may be arranged in series e.g. along the same axis or beam line. In this situation the RF energy transmission means e.g. waveguide(s) that recuperate energy may be arranged to transfer the energy in a direction substantially parallel to the beam path. Where the first and second devices comprise linear accelerators the recuperated RF energy may be transmitted parallel to the common axis of the devices. In other words, energy recuperated from a downstream decelerator device may be transferred back along the direction of the beam path to an upstream accelerator device.

However the applicant has appreciated that it is desirable to minimize the length of the transfer path for recuperated RF energy so as to potential mitigate energy losses, and so as to help reduce the overall size of the apparatus. In a preferred set of embodiments the first and second (preferably linear) accelerator and decelerator devices are arranged substantially in parallel or side-by-side and preferably with the RF energy transmission means e.g. waveguide(s) arranged to transfer the recuperated RF energy in a direction substantially orthogonal to the overall beam path through the devices. If the first and second devices are linear accelerators arranged in parallel then the RF energy transmission means may be arranged to transfer the recuperated energy in a direction substantially orthogonal to their axes. This means that the first and second (preferably linear) devices can be arranged substantially side-by-side with only short waveguide(s) to directly connect between them. Furthermore such embodiments are advantageous in that the apparatus can be made much more compact than a serial arrangement of the first and second devices. Since the largest dimension of a linear accelerator/decelerator device is usually its length, this tends to be the determinative factor for the overall size of such an apparatus.

In embodiments where the first/second accelerator/decelerator devices are arranged substantially in parallel or side-by-side rather than in series, the electron beam cannot pass straight through the apparatus along a single axis. Instead, means are preferably provided to turn the electron beam substantially through 180° between the first accelerator device and the second decelerator device. While the beam may be turned by any angle between 0° and 180° so as to make a more compact layout for the linear devices (for example, the linear devices may be arranged with an acute angle between them), the maximum benefit is achieved when the beam is turned fully through 180° so that the first and second devices can be arranged substantially side-by-side. Preferably a magnetic field is applied to turn the electron beam. The means may comprise one or more normal magnets and/or superconducting magnets.

When the accelerated electron beam from the first device is turned substantially through 180° before being decelerated by the second device, the interaction process can be arranged to be carried out at any point, including multiple points, on the electron beam trajectory as it passes between the accelerator device and the decelerator device. Such arrangements provide a marked deviation from the conventional straight beam lines of linear accelerator experiments. A more compact apparatus for electron beam interactions is made possible for a variety of experiments.

The applicants have further realized that turning the electron beam through an angle up to 180° can be particularly beneficial when interacting the accelerated beam with photons to generate x-rays via inverse-Compton scattering. Turning the beam provides an interaction zone where the angle of impact between a photon beam and the electron beam can be more freely selected to tailor the wavelength of the resultant x-rays. It can also be easier to select the direction of the x-rays that are generated so that they can be guided for subsequent use. With a serial arrangement of linear accelerators, on the other hand, it can be difficult to guide a photon beam so as to interact with the straight electron beam and to guide the x-rays away if they are generated close to the beam axis.

In a preferred set of embodiments means are provided to turn the electron beam substantially through 180° between the first accelerator device and the second decelerator device and the photon source is arranged to provide a beam of photons that interacts with the accelerated electron beam as it turns through an angle of about 90° from the axis of the first device. In a side-by-side layout as described above, a beam of x-rays can be generated that is directed substantially perpendicular to the beam path or axes of the linear devices, making it easier to use the x-rays without being hindered by the bulk of the apparatus. Such an arrangement can improve the conditions for inverse-Compton scattering, for example providing for focusing and compression of the electron beam as it is turned through 90° before reaching the interaction point. Compressing the electron beam before interaction with a photon beam can further increase the resultant x-ray flux. After interaction the electron beam can be decompressed as it is turned through a further 90° before entering the second device where RF energy is recuperated.

Compression of the electron beam for interaction may be achieved and augmented in a number of ways. In one set of embodiments, compression may be achieved by timing the injection of the electron beam into the first device so that a gradient of RF energy is produced in the accelerated beam before it is turned through 90° to reach the interaction point. The energy gradient from the head to tail of an electron bunch will result in the particles bunching together. In another set of embodiments, one or more of the RF cavities in the accelerator device can be arranged to give a transverse kick to the electron bunch, which will be z-position dependent, with the head and tail of the electron bunch receiving a transverse kick of the opposite polarity. Then, when the electron bunch is turned through 180°, the head and tail will travel on different trajectories that have different path lengths. The electron bunch will therefore compress longitudinally based on the difference in the path length, which can be tailored depending on the trajectory. The feature of compressing the electron beam can be useful for various interactions in addition to inverse-Compton scattering.

According to another aspect of the present invention there is provided a method for generating x-rays comprising the steps of: generating an electron beam; passing the electron beam through a first device arranged to apply an RF electric field to accelerate the electron beam; interacting the electron beam from the first device with photons so as to generate x-rays via inverse-Compton scattering; passing the electron beam through a second device arranged to apply an RF electric field to decelerate the electron beam after it has interacted; and arranging RF energy transmission connected between the first and second devices to recover RF energy from the decelerated electron beam as it passes through the second device and transfer the recovered RF energy into the first device.

According to a further aspect of the present invention there is provided a method for extracting energy from an electron beam comprising the steps of: generating an electron beam; passing the electron beam through a first device comprising a plurality of superconducting RF cavities in which an RF electric field is applied to accelerate the electron beam; extracting energy from the accelerated electron beam through an interaction process; passing the electron beam through a second device comprising a plurality of superconducting RF cavities in which an RF electric field is applied to decelerate the electron beam after it has interacted; and arranging one or more superconducting RF waveguide(s) connected between the first and second devices to recover RF energy from the decelerated electron beam as it passes through the second device and transfer the recovered RF energy into the first device.

According to a yet further aspect of the present invention there is provided a method for extracting energy from a particle beam comprising the steps of: generating a particle beam; passing the particle beam through a first superconducting device arranged to apply an electric and/or magnetic field to accelerate the particle beam; extracting energy from the accelerated particle beam through an interaction process; passing the particle beam through a second superconducting device arranged to apply an electric and/or magnetic field to decelerate the particle beam after it has interacted; and arranging superconducting means to recuperate, energy from the particle beam as it passes through the second device and transfer the recuperated energy into the first device; wherein at least the first device, second device and superconducting means are provided together in a cryostat.

BRIEF DESCRIPTION OF THE DRAWINGS

Some preferred embodiments of the present invention will now be described, by way of example only, and with reference to the accompanying drawings, in which.

DETAILED DESCRIPTION

Figure 1:
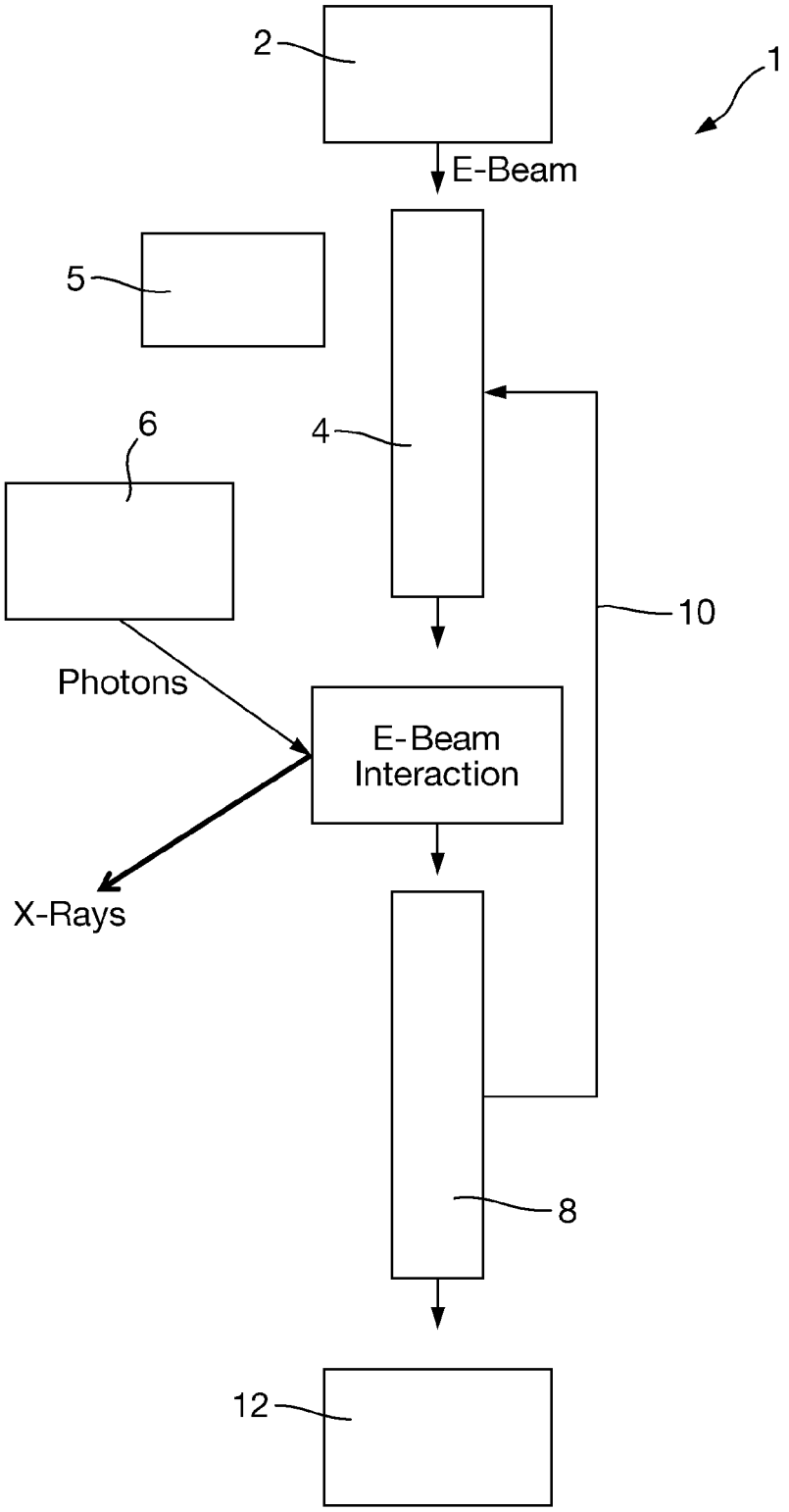
FIG. 1 is a schematic flow diagram showing the main components in an x-ray generating apparatus according to embodiments of the present invention.

There is seen from FIG. 1 the basic components of an x-ray generating apparatus 1 depicted in the form of a flow diagram (i.e. not representative of physical layout). An electron beam is generated by an electron gun 2, typically a radiofrequency (RF) photoinjector comprising a RF power supply, a laser source and a photocathode located in a RF cavity to produce bunches of electrons when photons from the laser impact on the photocathode. Such electron guns are well known and will not be described in further detail here. The electron beam (e-beam) generated by the gun 1 may be at an initial energy Emin e.g. around 1 MeV. The electron beam enters a first linear device 4 that is arranged to accelerate the beam up to an interaction energy Emax of about 20 MeV. The accelerator 4 includes a plurality of RF accelerating cavities to which an alternating RF electric field is applied. An RF power supply (not shown) may input around 10 kW of power to drive the acceleration process.

The electron beam leaving the accelerator 4 is at an energy Emax suitable for interaction. At this stage in the apparatus 1 a laser 6 is arranged to direct a photon beam to interact with the electron beam. A laser mirror cavity may provide for collisions between electron bunches and laser pulses. X-rays of keV scale are generated via inverse-Compton scattering and typically emitted in the direction of the electron beam. After the interaction, the electron beam enters a second linear device 8 that is arranged to decelerate the beam. The decelerator 8 also includes a plurality of RF cavities to which an alternating RF electric field is applied. A RF power supply (not shown) may input around 2 kW of power to drive the deceleration process. The RF energy that is given off by the electron beam as it decelerates is recuperated and transferred back to the accelerator 4 via an energy coupling 10. The de-energized electron beam that passes out of the decelerator 8 is sent to a beam dump 12.

The electron beam, after deceleration, is dumped at much lower energy Emin than its maximum energy. The energy Emin at the dump can be as low as 0.1 MeV, which is 200 times less than the maximum beam energy. Correspondingly, the RF power needed to accelerate the electron beam is about two hundred times lower than the reactive power of the electron beam at the point of interaction with the laser light.

A possible range of typical operating parameters is provided, for the sake of illustration, in Table 1 below.

TABLE 1

| Typical parameters, range | [ | | ] | |
|---|---|---|---|---|
| Electron beam E, MeV | 10 | 20 | 30 | |
| Electron bunch charge, nC | 0.2 | 0.5 | 1 | |
| e-bunch repetition rage, MHz | 50 | 200 | 1000 | |
| e-beam average current, A | 0.01 | 0.1 | 1 | |
| e-beam reactive power, MW | 0.1 | 2 | 30 | |
| e-beam energy at dump, MeV | 0.2 | 0.1 | 0.1 | |
| laser wavelength | 1000 | 600 | 300 | |
| X-ray max energy, keV | 2 | 12 | 60 | |
| X-ray min wavelength, nm | 0.6 | 0.1 | 0.02 | |
| X-ray flux, ray/s | 1.E+15 | 8.E+15 | 4.E+16 | |
| approx peak brilliance | 2.E+20 | 2.E+21 | 8.E+21 | ph/(s mm^2 mrad^2 0.1% bw) |
| approx RF power, kW | 2 | 10 | 100 | |
| e-Energy recovery coefficient | 50 | 200 | 300 | |

The energy recuperation provided by such an apparatus 1 greatly reduces the demands on the RF power supplies for the accelerator 4 and decelerator 8. It can be seen from Table 1 that the RF input to each linear device 4, 8 need only be of the order of 10 kW to produce an accelerated electron beam having an energy Emax of around 20 MeV and reactive power of, for example, 200 kW for the interaction process. The power in the beam can therefore be 200 times higher than would be possible without energy recuperation.

It will be understood the block diagram in FIG. 1 does not represent the actual spatial arrangement of the components in the apparatus 1 but is merely a schematic of the energy flow. While the linear decelerator 8 may be provided on the same beam line as the linear accelerator 4, to make the apparatus 1 compact it is preferred that the linear devices 4, 8 are spatially arranged side-by-side e.g. with their axes parallel. Typically a linear accelerator/decelerator device has a length about 10 times its diameter so the determining factor for the overall size of an apparatus is usually the layout of the linear devices. A parallel arrangement of the linear devices minimizes their footprint while the energy recuperation technique enables a final beam energy Emax to be achieved with a shorter accelerator, resulting in a much more compact apparatus than previous proposals. FIGS. 2-9 depict such a compact arrangement and will now be described in more detail.

Figure 2:
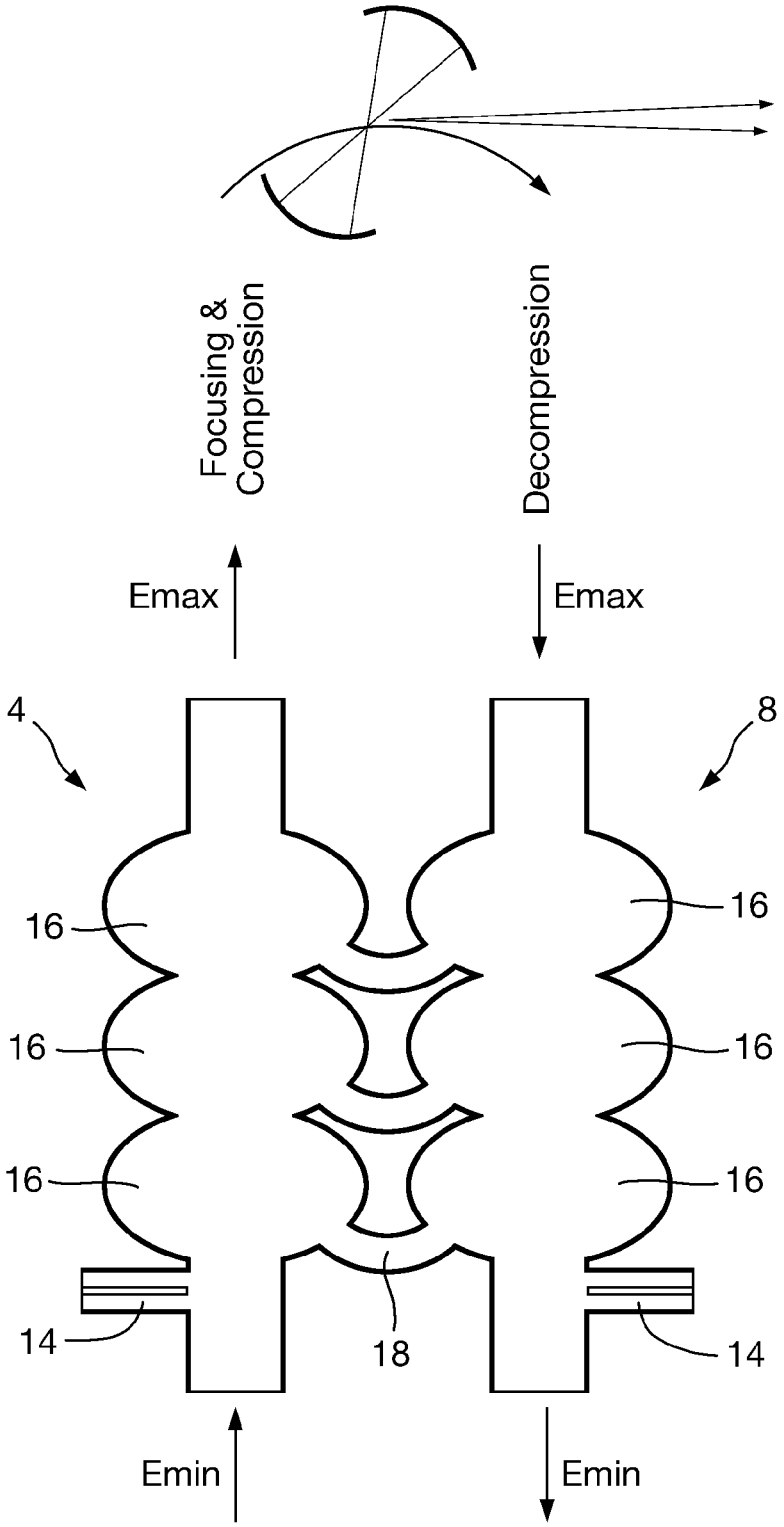
FIG. 2 is a schematic diagram showing the acceleration, interaction and deceleration of a particle beam with energy recuperation according to an embodiment of the present invention.

FIG. 2 provides a first example of an energy recuperation arrangement. A linear accelerator 4 and a linear decelerator 8 are provided in parallel, each with its own RF input 14. It is shown schematically that the linear devices 4, 8 each have a multi-cell structure comprising a number of RF cavities 16 arranged in series along the axis of the device 4, 8. Each RF cavity 16 is a waveguide tuned to create RF standing waves. The RF field is applied to electrodes (not shown) arranged along the length of the device 4, 8.

An electron (or other particle) beam enters the accelerator 4 with an initial energy Emin and exits with an interaction energy Emax. The accelerated beam is turned 180° so that it can enter the decelerator 8 after undergoing an interaction process. While the beam is being turned through the first 90° it is focused and compressed ready for interaction, for example in a laser cavity located at the 90° point in the beam's trajectory. Energy is extracted from the beam, for example in the form of x-rays generated by inverse-Compton scattering. While the beam is turned through another 90° it is de-compressed before passing into the decelerator 8. The beam may be turned by applying magnetic fields.

Figure 3:
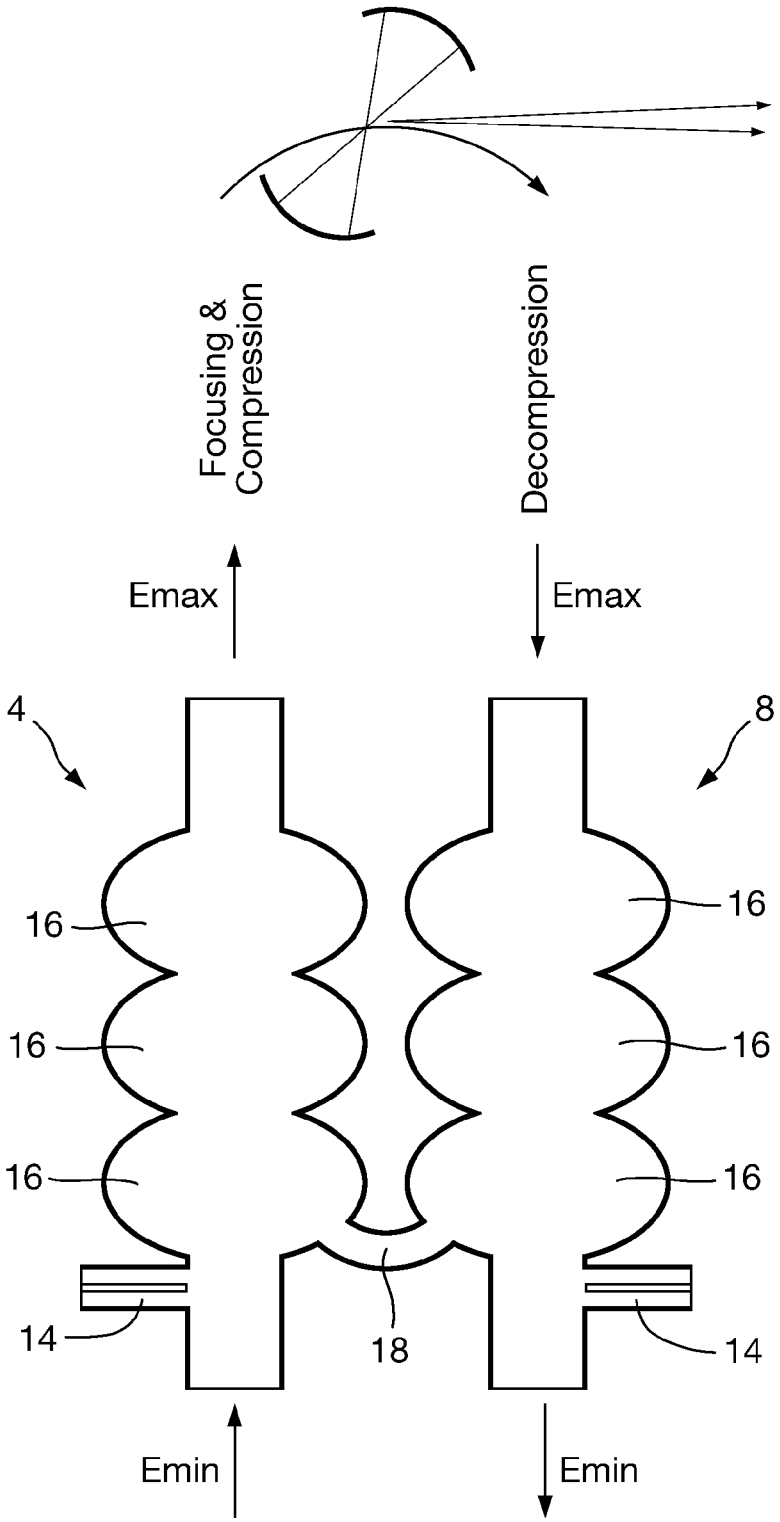
FIG. 3 is a schematic diagram showing the acceleration, interaction and deceleration of a particle beam with energy recuperation according to another embodiment of the present invention.

It can be seen from FIG. 2 that energy recuperated in the decelerator 8 is transferred back into the accelerator 4 by a plurality of RF waveguides 18 that couple the cavities 16 together. As the linear devices 4, 8 are arranged side-by-side, the RF couplings 18 can be relatively short so energy losses can be minimized. FIG. 3 shows another arrangement for recuperating energy. In this example, the accelerator 4 and decelerator 8 are coupled by a single RF waveguide 18 that connects the RF cavities 16 in one device to the other. It will be appreciated that the RF coupling 18 may take any suitable form, including single or multiple waveguides, separate or joined waveguides, or other channels suitable to transfer energy from the decelerator 8 to the accelerator 4.

Figure 4:
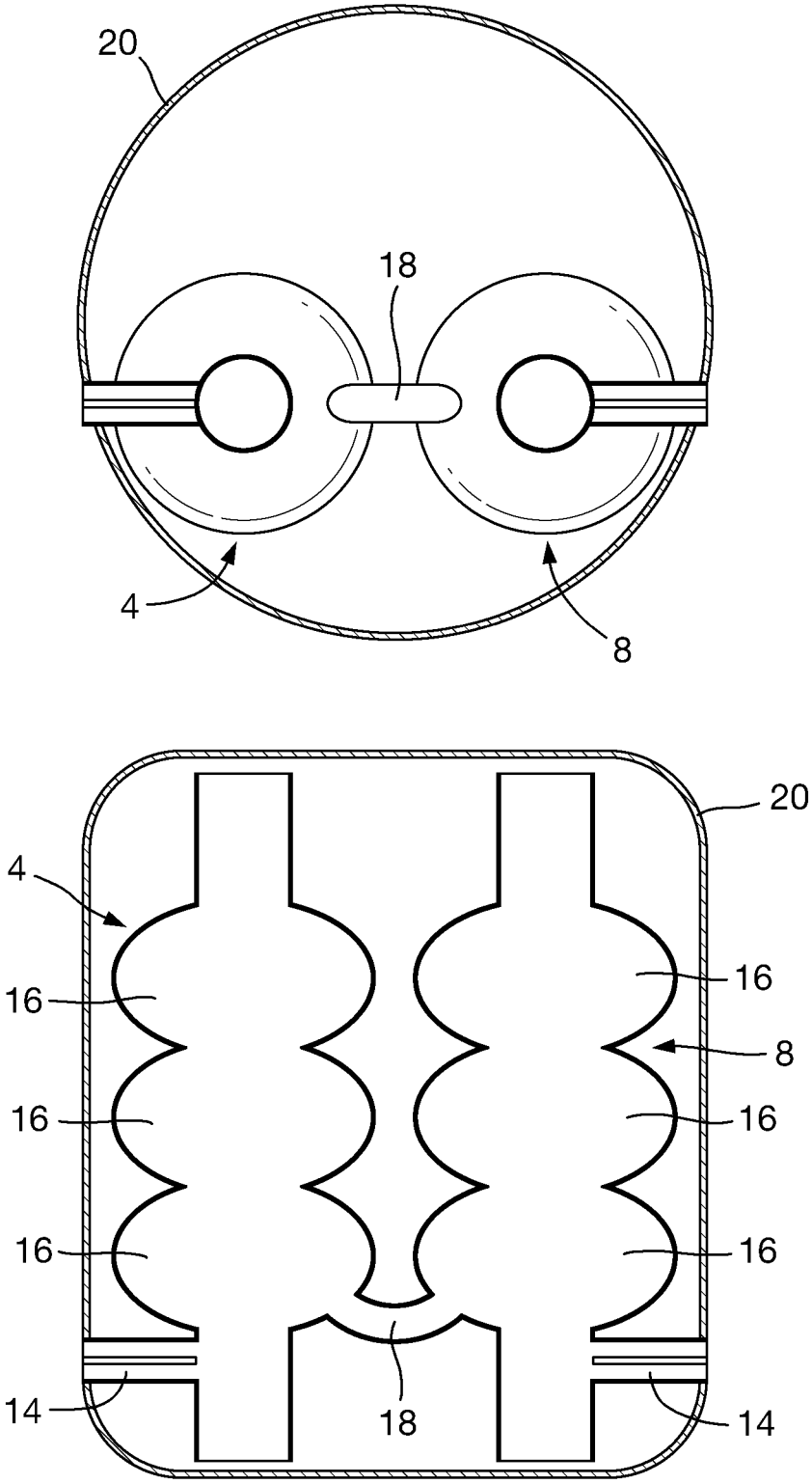
FIG. 4 is a schematic diagram showing detail from FIG. 3 in both plan and sectional views.

FIG. 4 shows a cryostat module 20 in which the accelerator 4 and decelerator 8 are embedded, together with their RF input supplies 14. Although only a single RF waveguide 18 is shown coupling together the RF cavities 16, there could of course be multiple couplings 18 as seen from FIG. 2. The RF coupling waveguide 18 is also embedded in the cryostat module 20. Each of the RF components can be formed of a superconducting material with the cryostat 20 used to maintain an operating temperature of around 2 K. An advantage of integrating the accelerator 4, the decelerator 8 and the RF coupling 18 into the same cryostat module 20 is that energy losses are minimized and the RF input power can be reduced. It is seen from the sectional view in FIG. 4 that arranging the two linear devices 4, 8 side-by-side in the same cryostat 20 results in a very compact module. The RF coupling 18 between the devices 4, 8 does not necessarily take up any additional space.

Figure 5A:
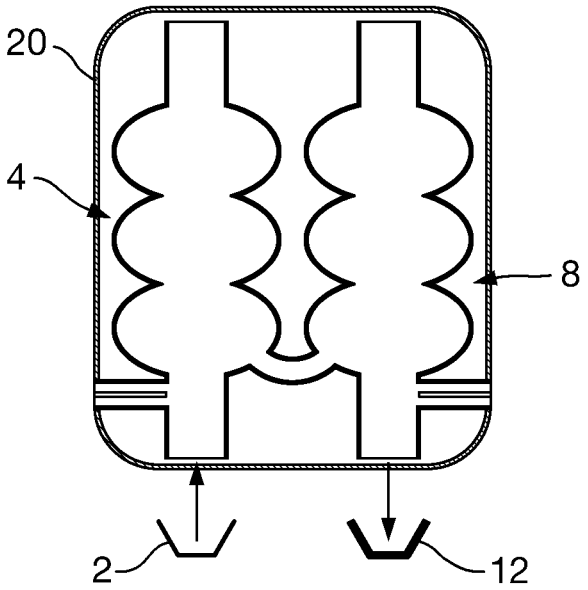
FIG. 5*a* is a schematic diagram of a cryostat module according to an embodiment of the present invention.
Figure 5B:
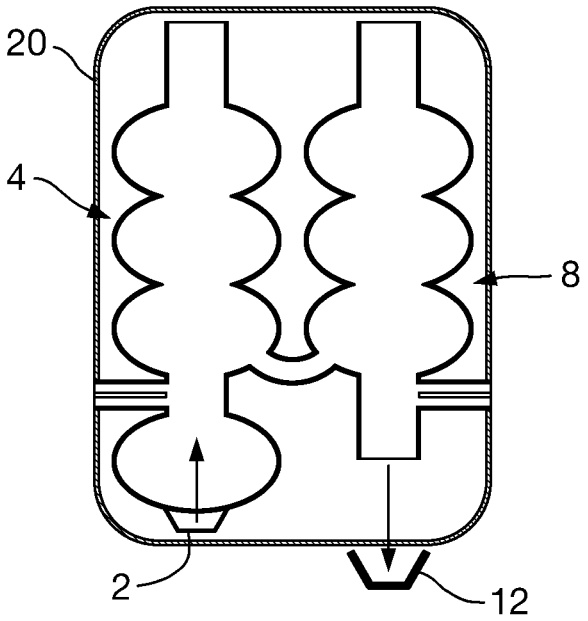
FIG. 5*b* is a schematic diagram of a cryostat module according to another embodiment of the present invention.

FIG. 5 provides some further examples of a cryostat module 20. In FIG. 5*a* it can be seen that both the electron gun 2 (or other particle generator) and the beam dump 12 are provided outside of the cryostat 20. The electron gun 2 may comprise a room temperature cavity or a superconducting cavity for the RF photoinjector. One advantage of using a superconducting cavity is that the electron beam can be either pulsed or continuous-wave. In FIG. 5*b* it can be seen that the electron gun 2, for example a superconducting photoinjector, is provided inside the cryostat 20 with the linear devices 4, 8. The beam dump 12 is kept outside the cryostat 20 to help minimise the cryo-cooling power. The built-in electron gun 2 shares the cryo-cooling with the other components so that less power is required for the superconducting components. In this case the required external RF power will be defined only by the energy to which the beam can be decelerated in the second linear device 8, while the full power of the beam at Emax can be orders of magnitude higher.

FIGS. 6-9 exemplify some of the possible interaction processes for the electron (or other particle) beam as it passes between the accelerator 4 and the decelerator 8. One or more of these interaction processes may be arranged to take place in the interaction block of the flow diagram shown in FIG. 1.

Figure 6:
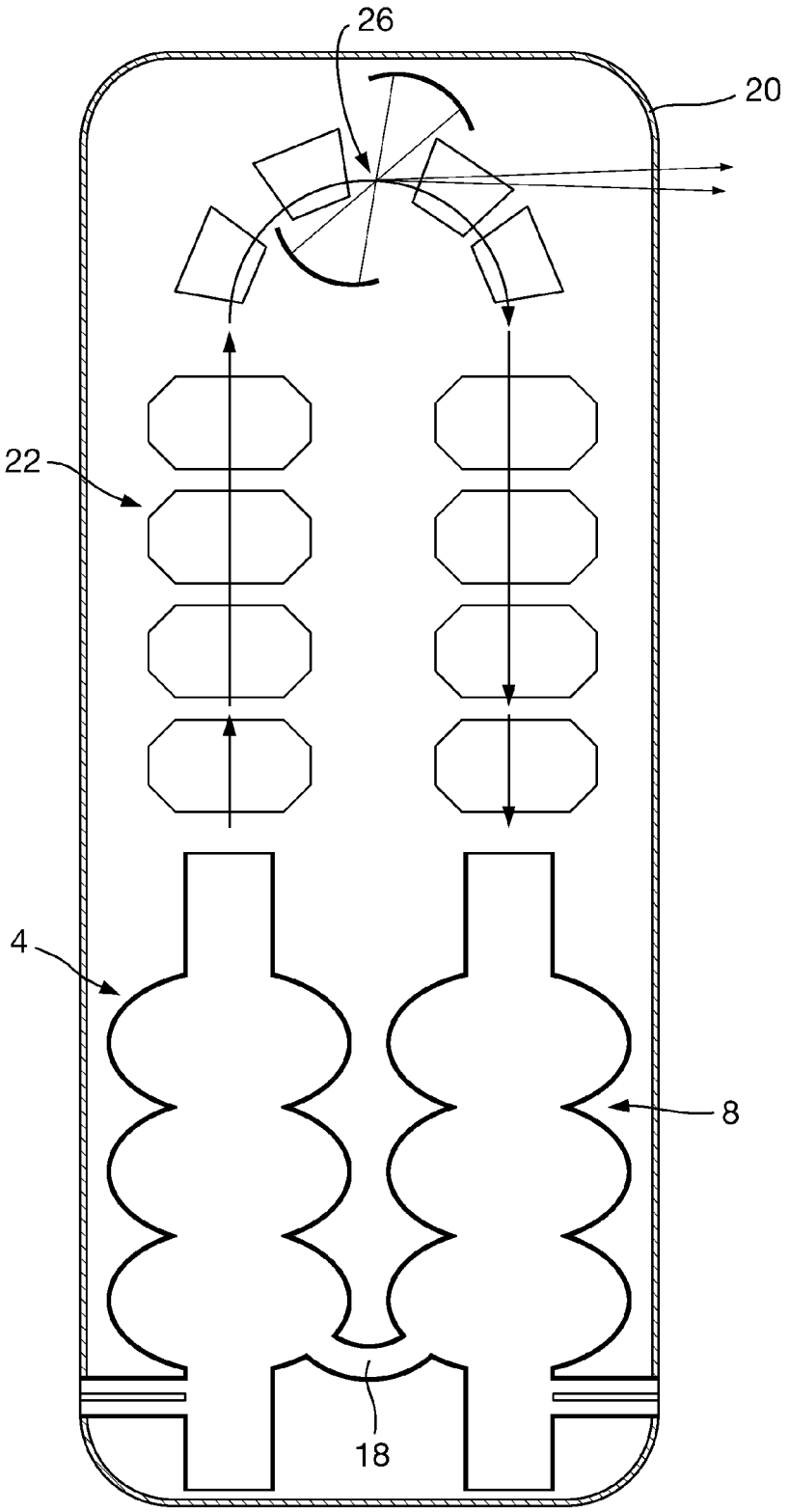
FIG. 6 is a schematic diagram of a cryostat module according to yet another embodiment of the present invention.
Figure 7:
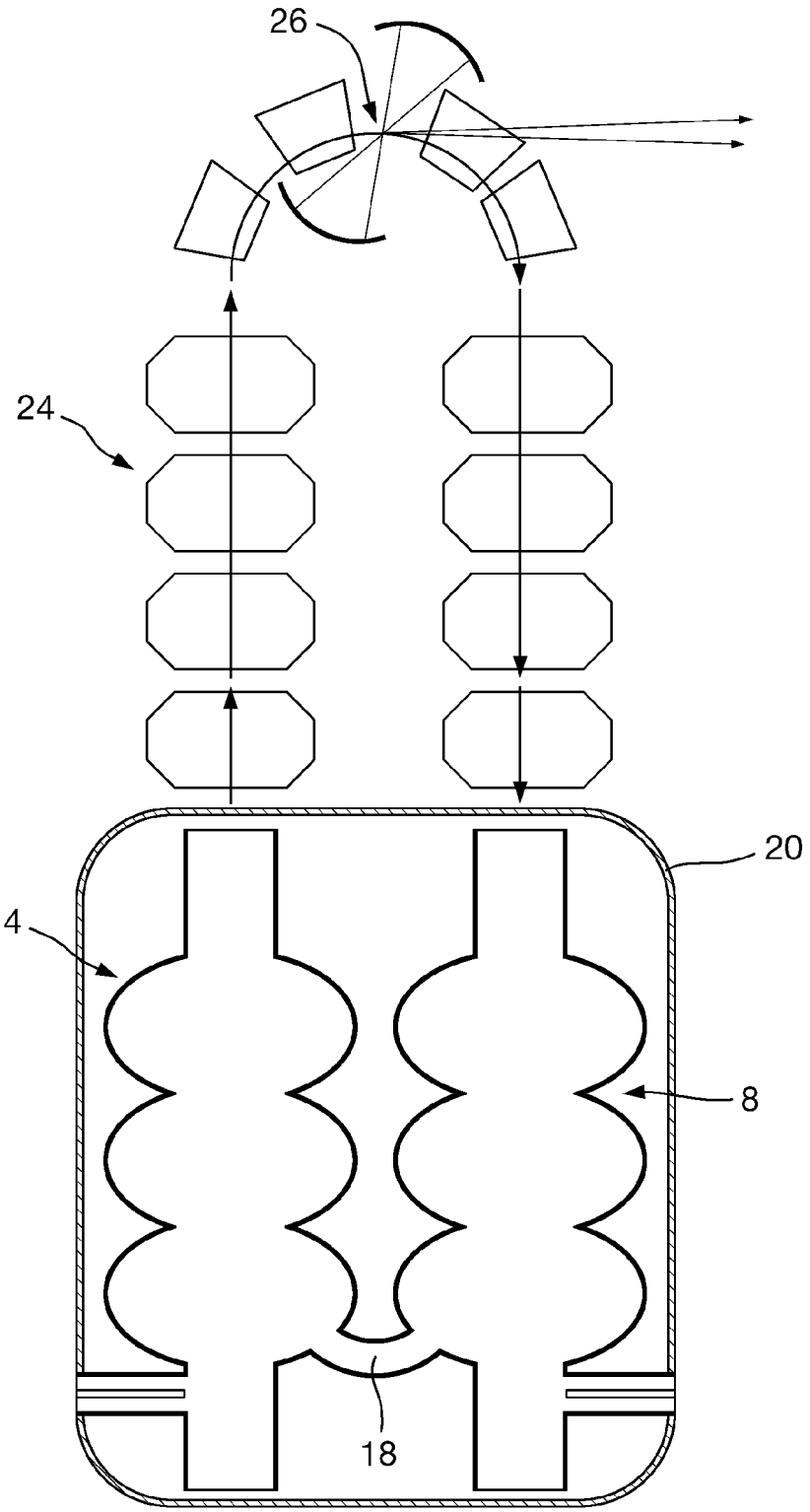
FIG. 7 is a schematic diagram showing the acceleration and deceleration of a particle beam with energy recuperation after an interaction process according to a first embodiment of the present invention.

In FIG. 6 an array 22 of superconducting magnets is embedded is the same cryostat 20 as the linear devices 4, 8 and used to transport, focus and compress the particle beam. As is shown, the beam may pass through a laser mirror cavity 26 where it interacts with photons to generate x-rays via inverse-Compton scattering. FIG. 7 shows a different version of the layout seen in FIG. 6. Instead of superconducting magnets, an array 24 of normal magnets provides for transport, focus and compression of the particle beam before it passes through the interaction zone 26. This magnetic array 24 is located outside the cryostat 20 that houses the linear devices 4, 8 and their RF coupling 18.

Figure 8:
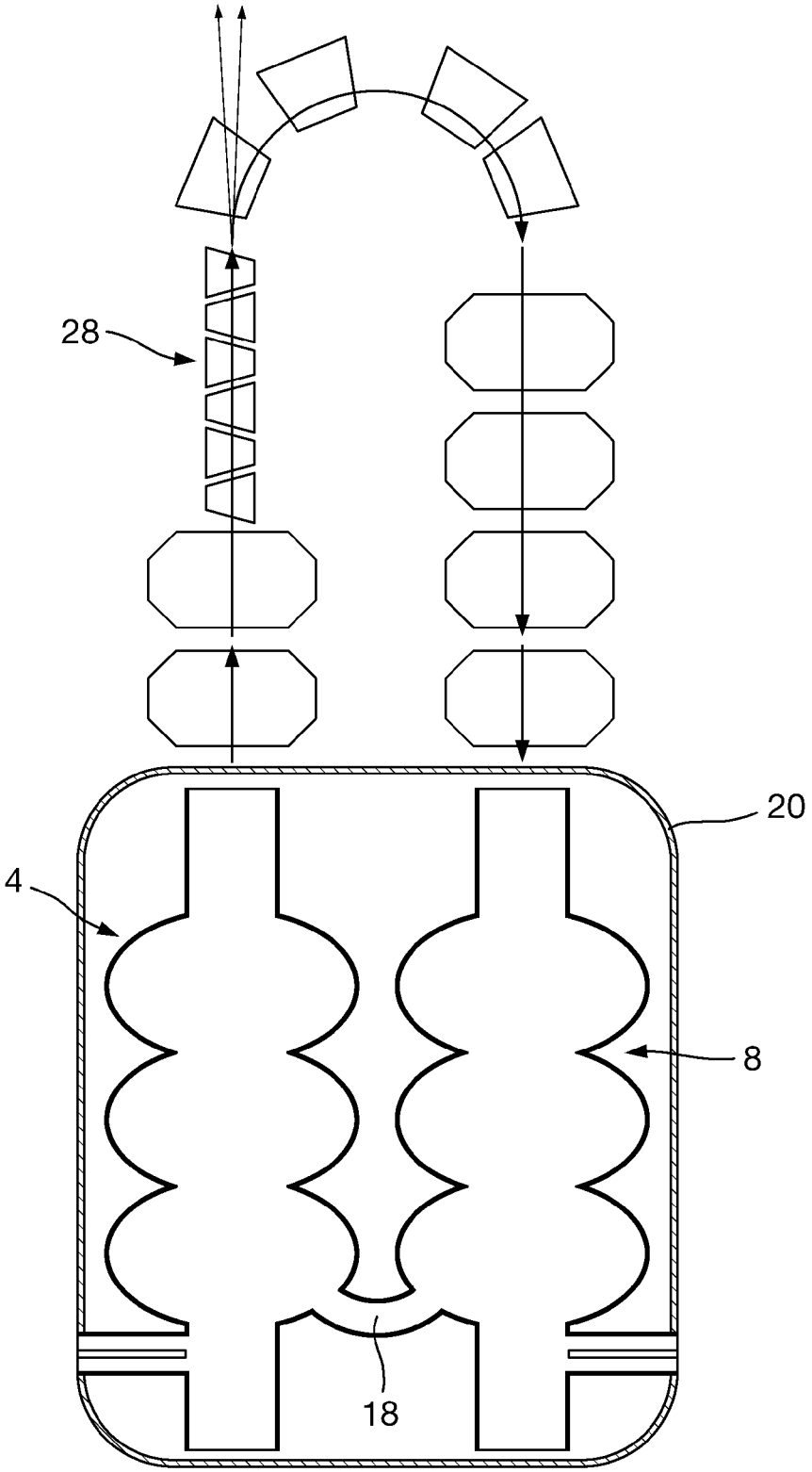
FIG. 8 is a schematic diagram showing the acceleration and deceleration of a particle beam with energy recuperation after an interaction process according to a second embodiment of the present invention.
Figure 9:
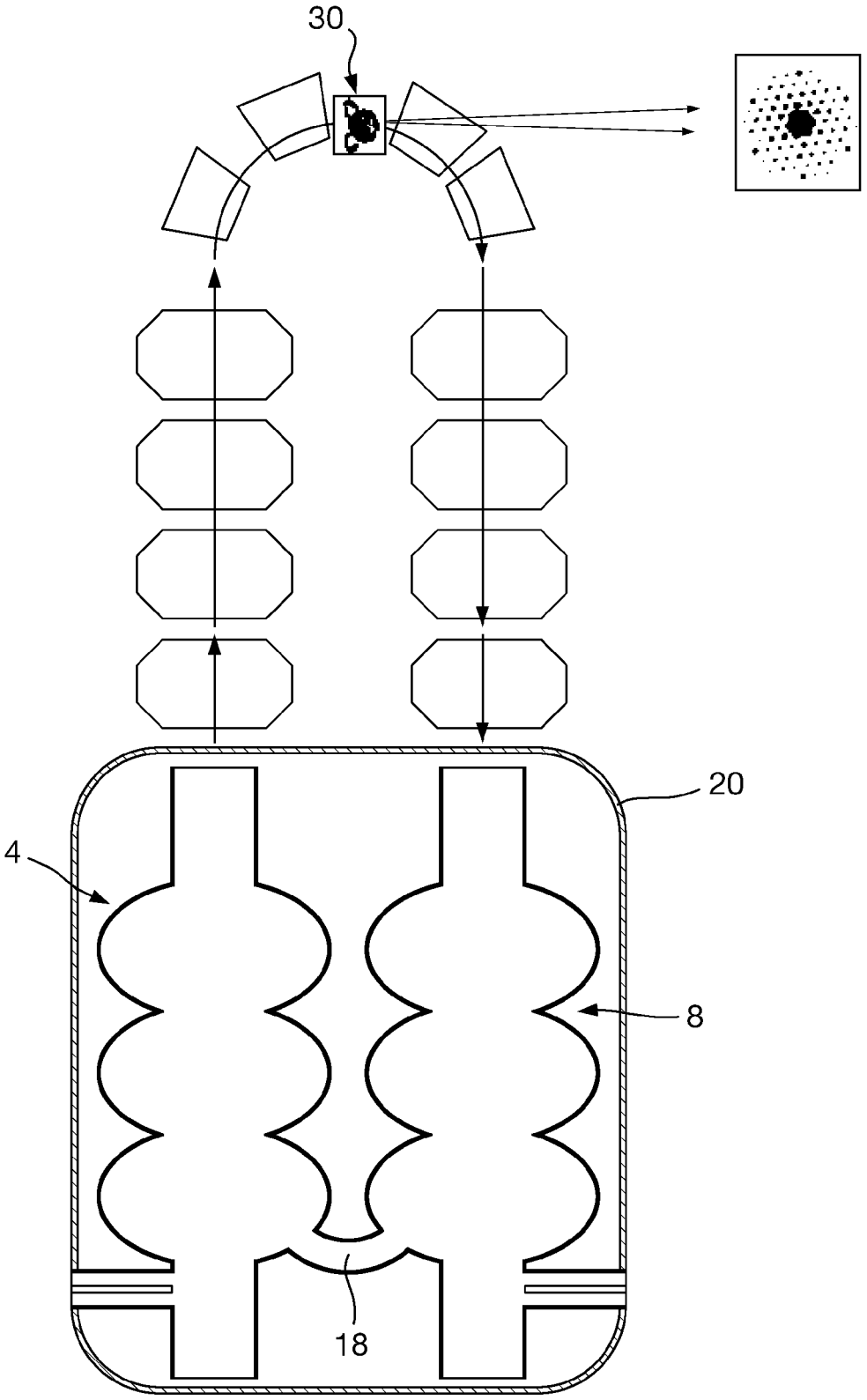
FIG. 9 is a schematic diagram showing the acceleration and deceleration of a particle beam with energy recuperation after an interaction process according to a third embodiment of the present invention.

In FIG. 8 there is shown an alternative interaction process. Instead of using inverse-Compton scattering to generate x-rays, the energized electron beam is transported by magnets and passed through an undulator 28 so as to generate x-rays on the principle of a free electron laser. FIG. 9 shows yet another interaction process, wherein the electron beam is not used to generate x-rays but instead is used directly to study a sample 30, e.g. via electron diffraction.

In all of the interaction processes described above the electron (or other particle) beam benefits from the RF energy recuperation between the decelerator and accelerator devices. Furthermore it will be appreciated that the schematic diagrams are not to scale and in reality each linear device may be of the order of 1 m long with a diameter an order of magnitude smaller. The side-by-side arrangement and integration of the linear devices can therefore provide a massive space-saving as compared to conventional linear layouts.

Although the preferred embodiments have been described above in relation to an electron beam, it will be understood that various features of these embodiments may be applied to other types of charged particle beam, including proton beams and ion beams. It will be appreciated that the electron or other particle beam may also be used for numerous interaction processes beyond those described.

Embodiments of the present invention have numerous industrial applications, including bio-medical applications e.g. clinical high resolution imaging and phase-contrast imaging, micro-tomography and x-ray protein crystallography, cultural/heritage applications e.g. imaging ancient artefacts, security monitoring e.g. nuclear resonance fluorescence, and extreme ultraviolet lithography.

What is claimed is:

1. An apparatus for extracting energy from a particle beam comprising:

a particle beam generator;

a first superconducting device arranged to apply an electric and/or magnetic field to accelerate the particle beam;

an arrangement configured to extract energy from the accelerated particle beam through an interaction process;

a second superconducting device arranged to apply an electric and/or magnetic field to decelerate the particle beam after it has interacted; and a superconducting electromagnetic coupling arranged to recuperate energy from the particle beam as it passes through the second device and transfer the recuperated energy into the first device;

wherein the first and second devices are arranged substantially in parallel and side-by-side; and wherein at least the first device, second device and superconducting coupling are provided together in a cryostat.

2. The apparatus of claim 1, wherein the first and second superconducting devices comprises a plurality of RF cavities in which an RF electric field is applied to accelerate/decelerate the electron beam.

3. The apparatus of claim 1, wherein the superconducting coupling arranged to recuperate energy from the particle beam comprises one or more waveguides that connect the first and second devices to transfer energy in the form of RF electromagnetic radiation.

4. The apparatus of claim 1, wherein at least one of the particle beam generator or the arrangement configured to extract energy from the particle beam is provided in the cryostat.

5. The apparatus of claim 1, wherein the particle beam comprises one or more of: electrons, positrons, protons, or ions.

6. The apparatus of claim 1, wherein the first and second devices are arranged substantially in parallel or side-by-side.

7. The apparatus of claim 1, wherein at least one of the first device or the second device is a linear accelerator.

8. The apparatus of claim 7, wherein the first device and the second device each include an axis, and the axes are arranged substantially parallel to one another.

9. The apparatus of claim 1, further comprising an arrangement configured to turn the beam substantially through 180° between the first device and the second device.

10. The apparatus of claim 9, wherein a photon source is arranged to provide photons to interact with the electron beam as the accelerated beam turns through an angle of about 90° after passing out of the first device.

11. The apparatus of claim 1, wherein:

the particle beam generator is an electron beam generator;

the particle beam is an electron beam;

the first superconducting device is arranged to apply an RF electric field to accelerate the electron beam from the generator;

the arrangement configured to extract energy from the accelerated article beam is a photon source arranged to provide photons to interact with the electron beam from the first device so as to generate x-rays via inverse-Compton scattering;

the second superconducting device is arranged to apply an RF electric field to decelerate the electron beam after it has interacted; and wherein the first and second superconducting devices are connected by the superconducting electromagnetic coupling, which is an RF energy transmission coupling arranged to recover RF energy from the decelerated electron beam as it passes through the second device and transfer the recovered RF energy into the first device.

12. The apparatus of claim 11, wherein the RF energy transmission coupling comprises one or more RF waveguides connecting the first and second devices.

13. The apparatus of claim 11, wherein at least one of the first device or the second device comprises one or more RF cavities arranged in series.

14. The apparatus of claim 13, wherein each RF cavity in the second device is coupled to a corresponding RF cavity in the first device by a respective waveguide.

15. The apparatus of claim 11, wherein the first and second devices each have respective upstream and downstream ends, and wherein the downstream end of the second device is connected to the upstream end of the first device by the RF energy transmission coupling.

16. An apparatus for extracting energy from an electron beam comprising:

an electron beam generator;

a first device comprising a plurality of superconducting RF cavities in which an RF electric field is applied to accelerate the electron beam;

an arrangement configured to extract energy from the accelerated electron beam through an interaction process; and a second device comprising a plurality of superconducting RF cavities in which an RF electric field is applied to decelerate the electron beam after it has interacted;

wherein the first and second devices are connected by one or more superconducting RF waveguide(s) arranged to recover RF energy from the decelerated electron beam as it passes through the second device and transfer the recovered RF energy into the first device;

wherein the first and second devices are arranged substantially in parallel and side-by-side; and wherein the superconducting RF cavities of the first and second devices and the superconducting RF waveguide(s) are provided in the same cryostat.

17. The apparatus of claim 16, wherein the interaction process comprises at least one of: interacting the electron beam with photons to generate x-rays via inverse-Compton scattering; passing the electron beam through an undulator or applying an alternating magnetic field to generate electromagnetic radiation; directing the electron beam onto a target to cause emission and/or fluorescence; or interacting the electron beam directly with a sample for electron diffractometry or microscopy.

18. The apparatus of claim 16, wherein the superconducting RF cavities of the first and second devices and the superconducting RF waveguide(s) are integrally formed or connected together.

19. The apparatus of 16, wherein the superconducting RF cavities of the first and second devices and the superconducting RF waveguide(s) are provided in the same cryostat.

20. A method for extracting energy from a particle beam comprising the steps of:

generating a particle beam;

passing the particle beam through a first superconducting device arranged to apply an electric and/or magnetic field to accelerate the particle beam;

extracting energy from the accelerated particle beam through an interaction process;

passing the particle beam through a second superconducting device arranged to apply an electric and/or magnetic field to decelerate the particle beam after it has interacted; and arranging a superconducting coupling to recuperate energy from the particle beam as it passes through the second device and transfer the recuperated energy into the first device;

wherein the first and second devices are arranged substantially in parallel and side-by-side; and wherein at least the first device, second device and superconducting coupling are provided together in a cryostat.

21. The method of claim 20, wherein the particle beam includes one or more of electrons, positrons, protons, or ions.

* * * * *